US007476421B2

(12) United States Patent
Shinohara et al.

(10) Patent No.: US 7,476,421 B2
(45) Date of Patent: Jan. 13, 2009

(54) METHOD OF APPLYING IN-SOLUTION OIL REPELLENT

(75) Inventors: Katsuhisa Shinohara, Kyoto (JP); Naoki Iwasaki, Ise (JP); Toshiya Tsujita, Kyoto (JP); Tomoki Ida, Kyoto (JP)

(73) Assignee: Nidec Corporation, Kyoto (JP)

( * ) Notice: Subject to any disclaimer, the term of this patent is extended or adjusted under 35 U.S.C. 154(b) by 0 days.

(21) Appl. No.: 11/379,065

(22) Filed: Apr. 18, 2006

(65) Prior Publication Data

US 2006/0231342 A1 Oct. 19, 2006

(30) Foreign Application Priority Data

Apr. 8, 2005 (JP) ..... 2005-119121
Mar. 7, 2006 (JP) ..... 2006-061863

(51) Int. Cl.
*B05D 5/00* (2006.01)
*B05D 1/26* (2006.01)
*B05D 1/28* (2006.01)
*B05C 1/00* (2006.01)

(52) U.S. Cl. ..... 427/407.1; 427/429

(58) Field of Classification Search ..... None
See application file for complete search history.

(56) References Cited

FOREIGN PATENT DOCUMENTS

| | | | | |
|---|---|---|---|---|
| JP | H06-171081 | A | | 6/1994 |
| JP | 2002-048133 | A | | 2/2002 |
| JP | 2004-211851 | A | | 7/2004 |
| JP | 2004-289957 | A | | 10/2004 |
| JP | 2005-218961 | | | 8/2005 |
| JP | 2005-218961 | A | * | 8/2005 |

* cited by examiner

*Primary Examiner*—William Phillip Fletcher, III
(74) *Attorney, Agent, or Firm*—Volentine & Whitt, PLLC

(57) ABSTRACT

Enables the uniform, accurate application, onto microscale areas, of an in-solution oil repellent of low viscousness and in which the solvent is of extremely high volatility. A contacting piece that comes into contact with a target for application of the repellent is encased inside a sheath structure that, including the contacting piece, is lent rigidity. Therein, while the in-solution oil repellent is fed along the inside of the sheath structure, along the contacting piece itself, and onto the repellent-application target, it is coated on by the contacting piece tracing the surface of the application target. Giving at least the application start-point two coats, or a number of applications greater than that, yields a coating film of still higher uniformity.

16 Claims, 7 Drawing Sheets

METHOD OF APPLYING IN-SOLUTION OIL REPELLENT

BACKGROUND OF THE INVENTION

1. Technical Field

The present invention relates to methods of superficially applying low-viscosity liquids onto given components. In particular, the invention relates to a method of coating on a low-viscosity, in-solution oil repellent obtained by dissolving a fluorine-based oil repellent resin in a highly volatile organic solvent.

2. Description of the Related Art

Forming coatings of oil-repellent resins, which primarily are fluoroplastic resins, on designated portions of mechanical devices to impart water-repellency or oil-repellency to those areas is conventional. Forming such coatings without restrictions has, however, proven difficult, in that various contrivances to do so have been brought about to date.

For example, methods of brush application, of spraying on with a sprayer, of dipping in a solution and subsequently drawing out and drying, of spin-coating, of transfer-printing, and of dripping a solution onto designated regions with a brush or like instrument are known. Furthermore, direct formation of an oil-repellent film onto the target surface by means of vacuum deposition or plasma polymerization has also been proposed.

Vacuum and other vapor-deposition techniques, however, necessitate large-scale equipment. Dip-coating and spin-coating are prohibitive of application to designated areas. With brush application, because the tip of the brush deforms, applying a material onto designated areas proves challenging. A particular problem with brush application is that the oil repellent solidifies due to evaporation of the solvent and clings to the brush in the vicinity of the tip, whereby the flexibility of the brush is compromised and at the same time clumps of the solidified oil repellent end up adhering to the target object, such that the applicability of this technique to precision components is especially problematic.

Japanese Unexamined Pat. App. Pub. No. 2004-289957 to Misu et al. discloses an ingenious method in which, using a pair of nozzles whose tips are closely adjacent, an in-solution oil repellent is on the one hand supplied from one of the nozzles while being aspirated through the other, whereby the oil repellent is applied locally with the nozzles being kept out of contact with the target object.

BRIEF SUMMARY OF THE INVENTION

A method of applying an in-solution oil repellent according to the present invention includes contacting onto a surface of a target object an applicator tip having rigidity such that it basically does not deform from the level of pressing required for applying the solution, and, via a contacting piece in the applicator tip, coating-on the in-solution oil repellent. A capillary gap through which the in-solution oil repellent is supplied opens near the contact surface where the contacting piece contacts the target object.

According to this method, the oil repellent is supplied from near the contact surface, and therefore the adverse effect of solidification of the oil repellent due to evaporation of the solvent is relatively small. Moreover, since the contacting piece has rigidity, microparticles of the oil repellent, which form due to solidification, pulverize by being pressed by the contacting piece and dissolve again in the in-solution oil repellent that is supplied subsequently. Therefore, the microparticles do not produce dust or contaminate the surrounding area. Moreover, since the contacting piece has rigidity, the size of the contact area does not vary throughout the application operation, so that the in-solution oil repellent can be applied at a constant width.

The applicator tip may be one that deforms when pressed against the repellent-coating target object. As long as the pressing force is constant, however, the amount of deformation will necessarily be constant. Likewise, if the force is removed, the tip will necessarily return to its original form quickly.

An application method in which the solution is applied, and after the solvent evaporates and the oil repellent loses flowability, the solution is applied once again to the same location also produces beneficial results. In some cases, broken bits of oil repellent solidified near the tip end of the contacting piece do not disappear sufficiently by a single application. Even in such cases, uniformity of the coating film can be enhanced by applying the solution a plurality of times.

In the double application, at least the starting point of the oil repellent application needs to be coated two times. The oil repellent solidified at the tip end of the contacting piece is very likely to remain at the repellent-application starting point, but by applying the oil repellent two times to at least that portion, it is possible to improve the portion in which the problem is most likely to occur.

Since the viscosity of the in-solution oil repellent is often very low, the amount of outflow may be too large unless the size of the capillary gap or the like is selected appropriately. Even when the size of the capillary gap cannot be selected freely, a large amount of outflow of the in-solution oil repellent due to hydraulic pressure is prevented by keeping the opening of the capillary gap and the liquid surface of the in-solution oil repellent substantially at the same level.

As another method of adjusting the amount of outflow of the in-solution oil repellent, a porous material or the like for restricting the flow of fluid may be disposed in the interior of a reservoir for the in-solution oil repellent, or in a flowpath for supplying the in-solution oil repellent to the capillary gap. This may be disposed at a portion that is immersed in the in-solution oil repellent, or may be attached near the opening of the reservoir that is not immersed in the in-solution oil repellent. The flow resistance of the in-solution oil repellent or the flow rate of the air coming from outside into the reservoir drops, allowing the outflow rate of oil repellent from the opening of the capillary gap to lower. When this method is used, it is possible to employ a configuration in which hydraulic pressure is applied intentionally.

The applicator tip may be configured so that the circumference of the contacting piece is covered by a sheath. Covering with the sheath prevents the in-solution oil repellent from evaporating. In addition, by imparting rigidity or resilience to the sheath, it becomes possible to select a material with smaller rigidity or resilience for the contacting piece.

A rolling object may be employed as the contacting piece. The contacting piece is rotated relative to the object to which the in-solution oil repellent is applied, so that the in-solution oil repellent can be applied while the contacting piece is being rolled. The application may be made even with materials that are not suitable for application by sliding the contact surface.

As a configuration of the applicator tip, a solid member may be used as the contacting piece and a capillary gap may be secured between the contacting piece and a sheath. Conversely, a material having micro-gaps in the interior thereof may be selected as the contacting piece, and the micro-gaps may be used as the flowpath of the in-solution oil repellent. Moreover, a porous material may be used as the contacting piece. The applicator tip may have an elongated shape. This facilitates the operation of coating repellent onto very narrow areas. Application to narrow areas between component parts is also facilitated.

The use of an urging mechanism for pressing the applicator tip against the object to which the oil repellent is applied is efficacious. A high-quality coating film is obtained with a simple mechanism.

From the following detailed description in conjunction with the accompanying drawings, the foregoing and other objects, features, aspects and advantages of the present invention will become readily apparent to those skilled in the art.

DETAILED DESCRIPTION OF THE INVENTION

Spindle motors that are built into such devices as hard disk drives in many cases have a shaft on the surface of which an oil-repellent film composed of fluoropolymer is formed to prevent the lubricant from leaking. In the in-solution oil repellent applied to the shaft surface the concentration of the fluoropolymer is typically 1% and the solvent used is highly volatile. The application method according to the invention was carried out to apply this kind of solution using application apparatus as described in the following.

First Embodiment

Figure 1:
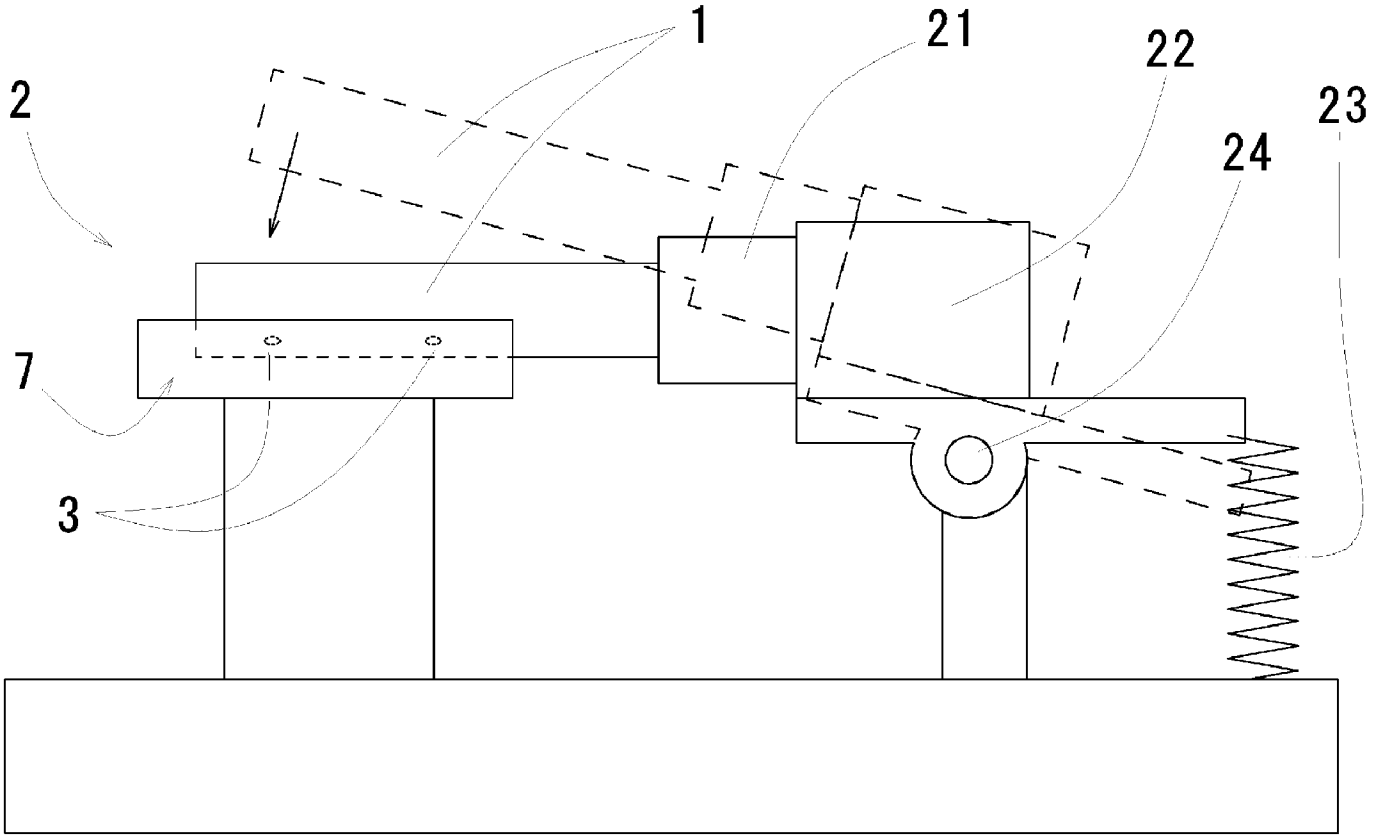
FIG. 1 illustrates an example of an applicator for applying an in-solution oil repellent.
Figure 2:
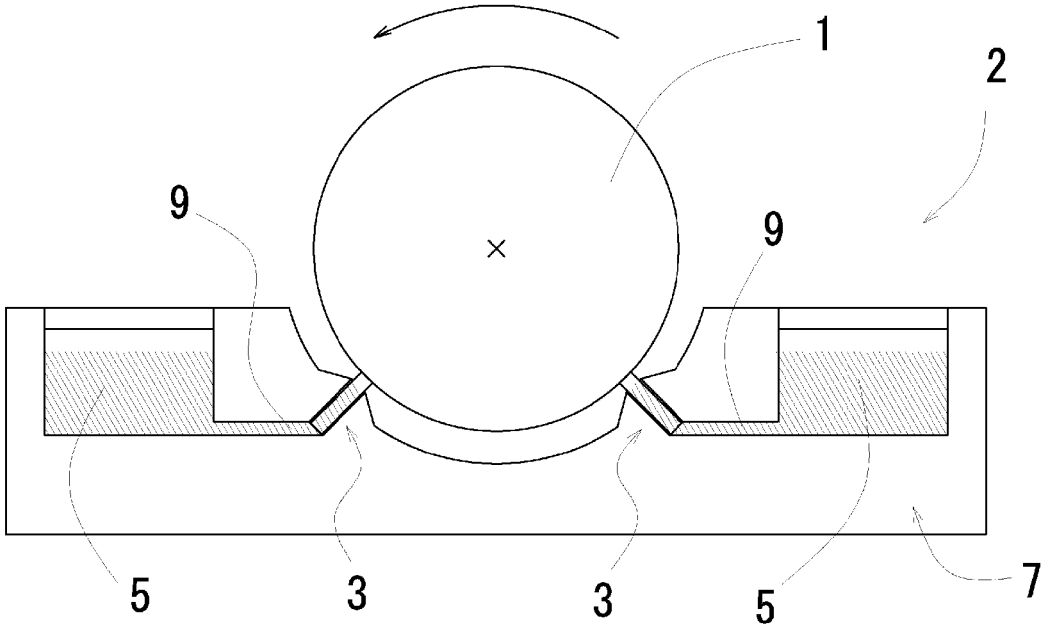
FIG. 2 is an enlarged view of the applicator.

FIG. 1 illustrates the overall configuration of an applicator 2 for applying the in-solution oil repellent on a circumferential surface of the shaft. FIG. 2 illustrates a portion of the applicator near applicator tips for applying the in-solution oil-repellent, viewed in a shaft-axis direction.

A work holder 7 serves to hold the shaft in a position where the oil-repellent is applied to the shaft. In this example, the shaft has a diameter of 2.5 mm. The work holder 7 has an inwardly curved surface at its center, and the inner side of the curved portion is provided with two applicator tips spaced apart along the shaft axis. A shaft 1, which is an object to which the oil-repellent is to be applied, is connected to a rotating mechanism 22 via a chuck 21 so that it can be rotated when applying the oil-repellent. The shaft 1, the chuck 21, and the rotating mechanism 22 are supported by a hinge joint 24 so that the front end side of the shaft can be lifted, as illustrated by dotted line in the figure. With the configuration illustrated in FIG. 1, because the left hand side of the hinge joint 24 in the figure is heavier, the shaft 1 is automatically pressed against the work holder 7 due to the effect of gravity. If the pressing force is so large that the tip ends of the applicator tips 3 deform, a spring 23 may be provided to tug backwards on the rotating mechanism 22 to reduce the urging force to an appropriate level.

Even if the shaft 1 is attached to the rotating mechanism 22 slightly tilted, the tilt may be compensated since the shaft's front end can be lifted easily; therefore, the oil-repellent is applied stably. The same applies even if the shaft surface has slight surface unevenness.

Referring to FIG. 2, two applicator tips 3 for applying the in-solution oil repellent to the shaft surface are provided along the shaft circumference. Providing two applicator tips 3, 3 enables them to support the shaft 1 stably when applying the solution. The two applicator tips 3, 3 may supply in-solution oil repellents with varying concentrations. The applicator tips 3, 3 are supplied with the in-solution oil repellent via flowpaths 9, 9 from reservoirs 5, 5. Varying the concentration of the in-solution oil repellent in the reservoirs enables application of solutions with varying concentrations.

Because the solvent of the in-solution oil repellent vaporizes very quickly, under conditions in which the shaft is rotated about two times a second, the in-solution oil repellent loses flowability and solidifies before the shaft undergoes one rotation. The in-solution oil repellent applied by the applicator tip that is on the right in FIG. 2 solidifies before it reaches the applicator tip that is on the left.

It is also acceptable that the applicator tip 3 be in a single location. Since the application is carried out while the shaft 1 is being rotated, only one applicator is sufficient to apply the in-solution oil repellent onto the whole circumference, and to apply two coats easily. While in this embodiment application was conducted at a rate of rotation of 100 rpm, the rate of rotation may be faster; but application becomes problematic at a rate higher than 300 rpm.

Second Embodiment

Figure 3:
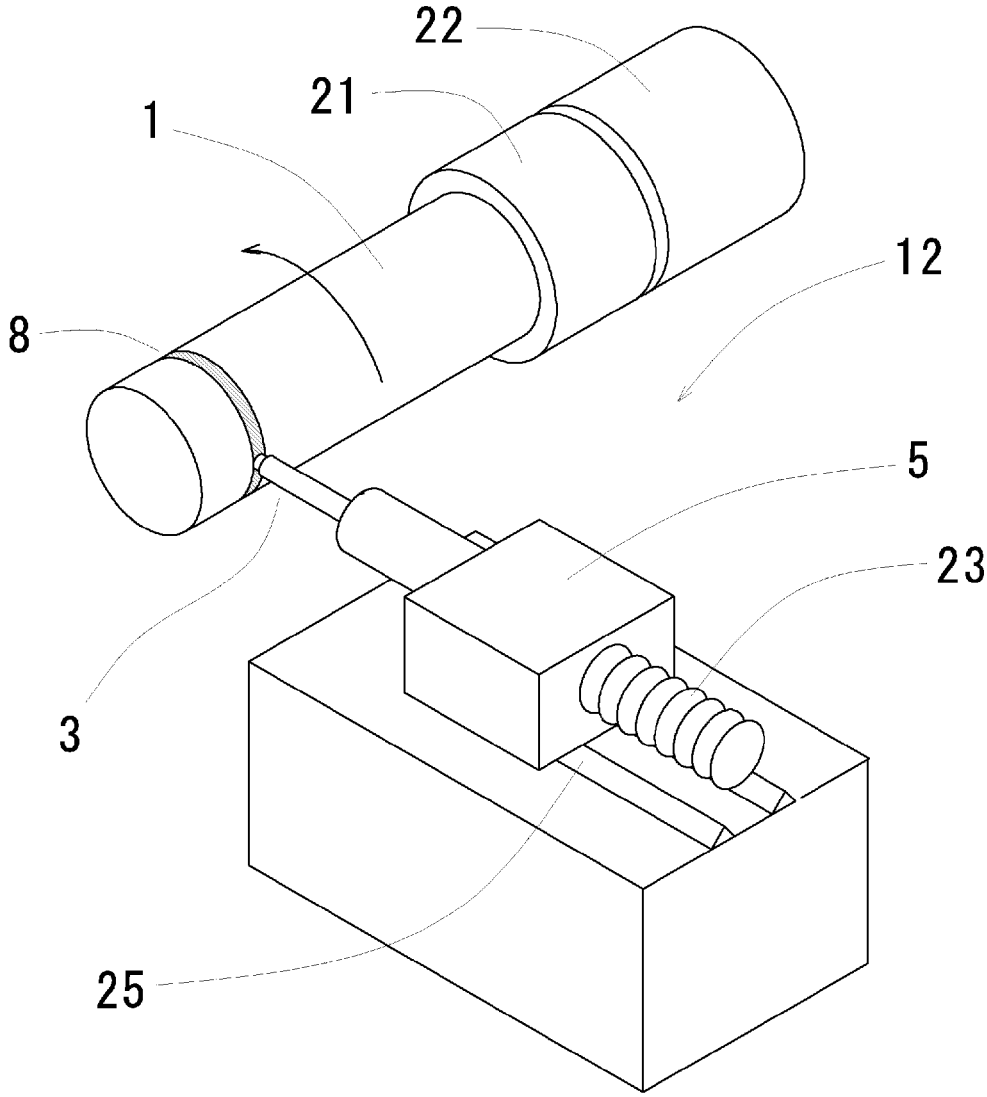
FIG. 3 is another example of the applicator for applying an in-solution oil repellent.

FIG. 3 is a schematic view illustrating an applicator 12 according to another embodiment. In the applicator 12 an applicator tip 3 is supported by a sliding mechanism 25 that can move along a radial direction of the shaft 1. The applicator tip 3 and a reservoir 5 are pressed against the shaft surface by a spring 23, so that the in-solution oil repellent is applied while the shaft 1 is being rotated. The spring and the sliding mechanism serves to compensate the tilt and surface unevenness of the shaft 1 to enable stable application of the solution. It should be noted that a chassis or the like for mounting the applicator 12 is not depicted in FIGS. 1 through 3 for simplicity.

Third Embodiment

Figure 4A:
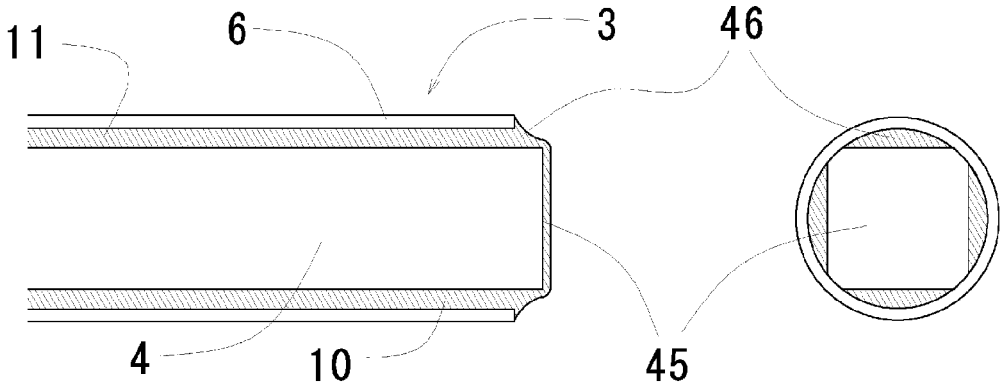
FIG. 4 illustrates an example of an applicator tip.
Figure 4B:
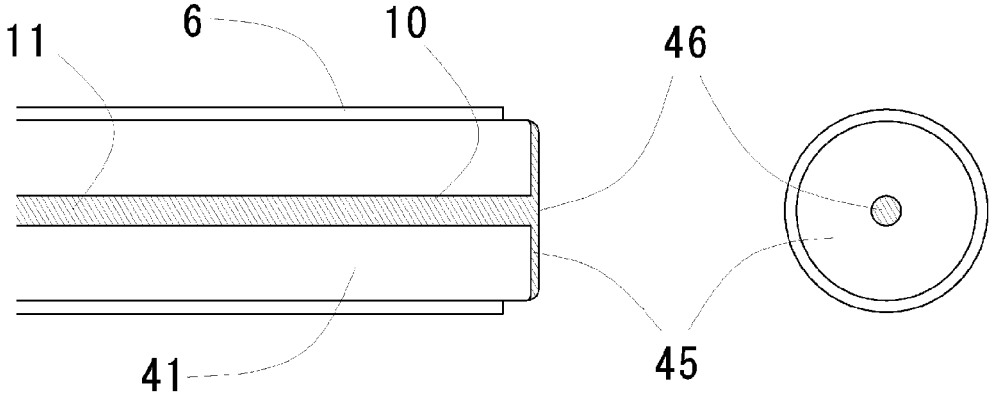

FIGS. 4A and 4B are enlarged views illustrating examples of the applicator tip 3, which show cross-sectional views on the left and front views on the right.

Referring to FIG. 4A, the applicator tip 3 has a contacting piece 4 that is rectangularly prismatic in form, and a sheath 6 for accommodating the contractor 4 therein. Capillary gaps 11 extending along the axis form at four circumferentially separate locations between the contractor 4 and the sheath 6. The interior of the capillary gaps 11 are filled with the in-solution oil repellent to openings 46 near the tip end of the applicator tip 3.

A contact surface 45 forms adjacent to the openings 46 of the capillary gaps, on which the in-solution oil repellent spreads along the surface of the contacting piece 4, and the in-solution oil repellent is applied onto the surface of the object to which the in-solution oil repellent is to be applied in the application work.

Referring to FIG. 4B, a contacting piece 41 has a capillary gap 11 extending along the axis and having an opening in the center of a contact surface 45. Outside the region depicted in the drawing, the capillary gap 11 is connected to a reservoir from which the in-solution oil repellent is supplied. Unlike the method illustrated in FIG. 4A, solidified oil repellent rarely forms at the opening of the capillary gap during the application work because the opening is at the center of the contacting piece.

Since the sheath 6 has a sufficient rigidity in both the applicator tips shown in FIGS. 4A and 4B, the applicator tips 3 as a whole have great rigidity so that precise application work can be carried out stably.

Fourth Embodiment

Figure 5A:
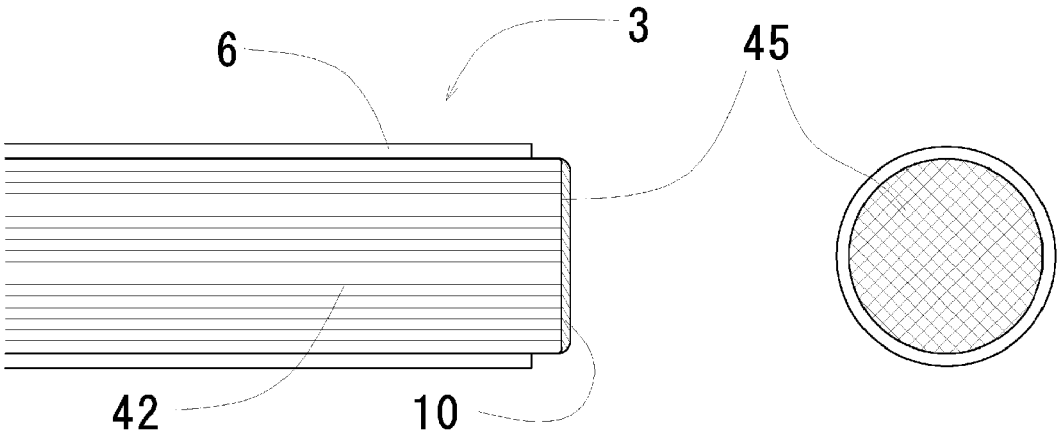
FIG. 5 illustrates another example of the applicator tip.
Figure 5B:
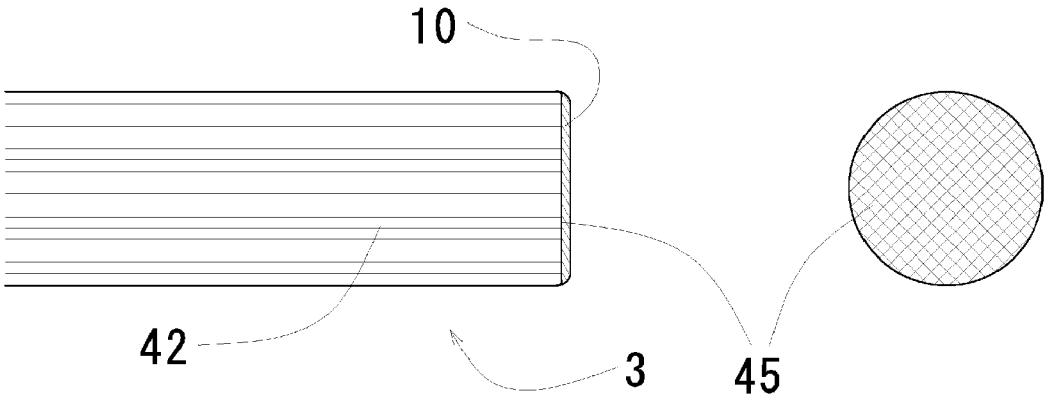

FIGS. 5A and 5B are enlarged views illustrating other examples of the applicator tips 3, which show cross-sectional views on the left and front views on the right.

Referring to FIG. 5A, a contacting piece 42 is made of a bundle of fine fibrous material having micro-gaps through which a liquid can flow along the axis direction. The contacting piece 42 is accommodated in the interior of a sheath 6, which ensures rigidity. The rear end of the contacting piece 42 is connected to a flowpath, which is not illustrated in the figure, through which the in-solution oil repellent is supplied. The micro-gaps themselves form the termini of the flowpath. The in-solution oil repellent 10 in this case oozes out on the tip end of the contacting piece 42 to cover the tip end.

FIG. 5B illustrates an example of a simpler configuration of the applicator tip. Referring to FIG. 5B, a contacting piece 42 is likewise formed by a bundle of fine fibrous material having micro-gaps through which a liquid can flow along the axis direction. Unlike the applicator tip shown in FIG. 5A, that shown in FIG. 5B does not have a sheath 6. The rigidity of the applicator tip is ensured by the contacting piece 42 alone. For this reason, the degree of deformation of the applicator tip by depressing is greater than the configuration shown in FIG. 5A. Nevertheless, selecting the material appropriately allows the contacting piece to have a sufficient resilience. Therefore, the configuration shown in FIG. 5B is also capable of smooth application work.

Moreover, since the configuration shown in FIG. 5B does not have a sheath 6, a large amount of solvent evaporates from the side face of the

Fifth Embodiment

Figure 6:
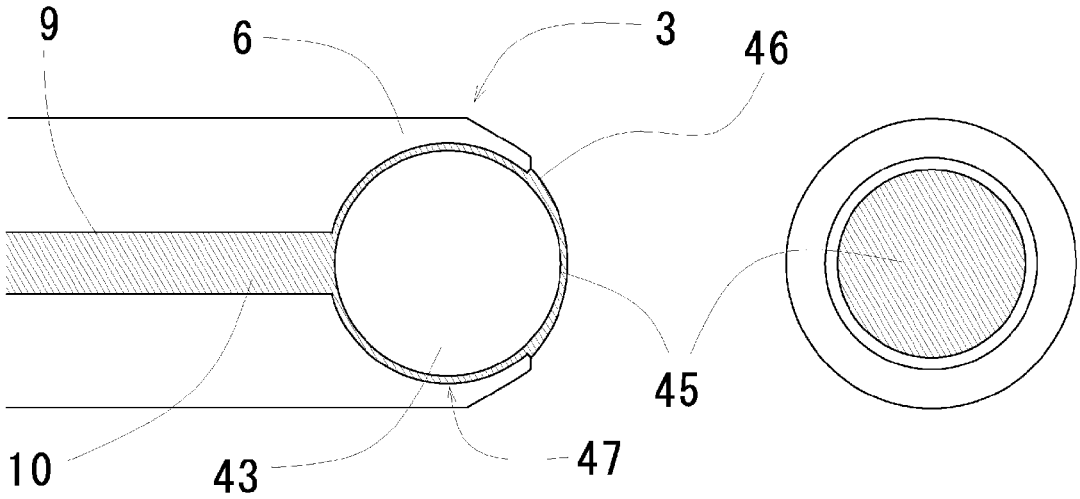
FIG. 6 illustrates still another example of the applicator tip.

FIG. 6 illustrates an example in which a contacting piece 43 has a spherical shape. The spherical contacting piece 43 is held freely rotatively in a recess 47 formed at one end of a sheath 6 so that a capillary gap is provided between the inner circumferential surface of the end portion and the surface of the contacting piece 43. The in-solution oil repellent is supplied to the capillary gap through a flowpath 9 and is delivered by the rolling motion of the contacting piece 43 to a contact surface 45 that faces an object to which the in-solution oil repellent is to be applied. The capillary gap itself forms the terminus of the flowpath 9. In this configuration, the contacting piece 43 rotates at all times during the application, so the contact surface 45 shifts to adjacent locations on the sphere one after another.

The applicator tip 3 shown in FIG. 6 applies the in-solution oil repellent by means of rolling motion, not sliding motion, of the contact surface and is therefore suitable for such applications that the application accompanying sliding is inappropriate.

Sixth Embodiment

Figure 7:
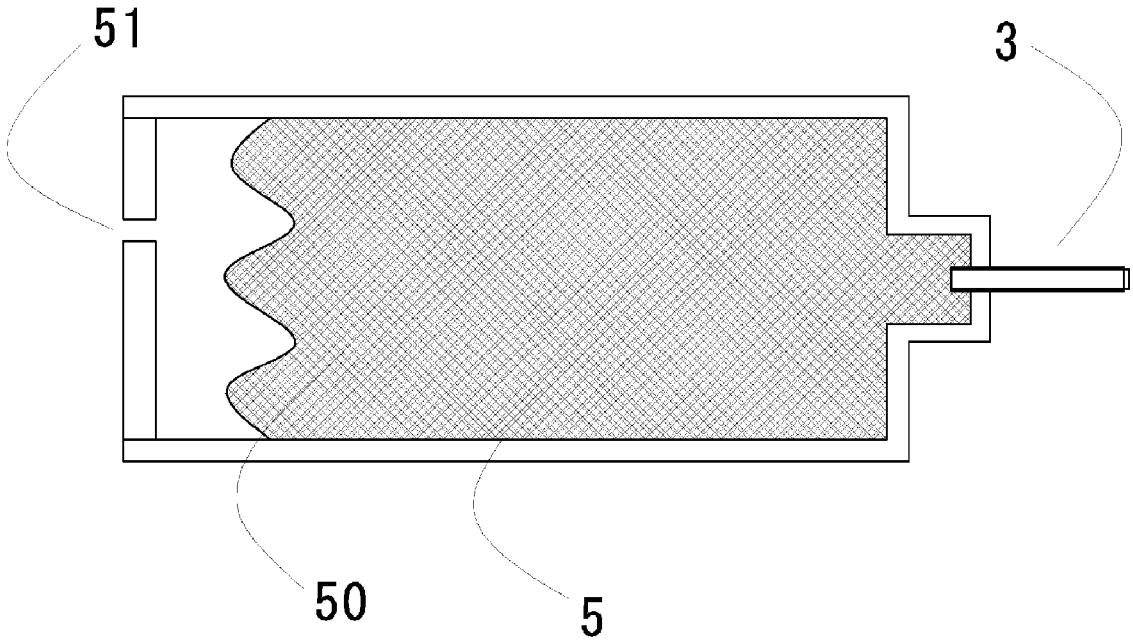
FIG. 7 illustrates an in-solution oil repellent reservoir.

FIG. 7 shows an embodiment in which adsorbent fibers 50 are filled in the interior of the reservoir 5 so that the in-solution oil repellent can be held in the reservoir more stably. The adsorbent fibers may pack the entire interior of the reservoir, or may be fitted only near an air vent 51 to restrict airflow into the reservoir. Either way makes it possible to reduce the flow rate of the in-solution oil repellent, which has a very low viscosity and flows out very easily, from one end of the applicator tip, so that the outflow of an excessive amount of in-solution oil repellent can be prevented. It should be noted that instead of the adsorbent fibers 50, the reservoir may be filled to a given extent with a particulate substance.

Other Embodiments

Although the first to six embodiments above illustrate a cylinder-shaped shaft as the object to which the in-solution oil repellent is applied, applications of the application method of the invention is not limited to cylindrical components. The application method according to the invention may even be applied to an inner circumferential surface of cylindrical bearing sleeve as long as the tip(s) of the applicator can be brought in contact therewith. The application method according to the invention may of course be applied easily to non-curved surface portions of machine components, such as flat surfaces.

Only selected embodiments have been chosen to illustrate the present invention. To those skilled in the art, however, it will be apparent from the foregoing disclosure that various changes and modifications can be made herein without departing from the scope of the invention as defined in the appended claims. Furthermore, the foregoing description of the embodiments according to the present invention is provided for illustration only, and not for limiting the invention as defined by the appended claims and their equivalents.

What is claimed is:

1. A method of applying to a region of a machine component an in-solution oil repellent obtained by dissolving an oil-repellent resin in a solvent, the method utilizing an applicator device made up of an applicator tip internally having a microthin flowpath that allows the in-solution oil repellent to flow through it, the microthin flowpath dimensioned to impart viscous resistance to the in-solution oil repellent when the repellent flows through the flowpath interior, a contacting piece disposed in an end portion of the applicator tip, in a position enabling a contacting surface of the contacting piece to be pressed against the region of the machine component during the repellent-application operation, wherein one end of the applicator-tip flowpath opens on a portion of the contacting piece, and a reservoir storing the in-solution oil repellent is stored and connected to the other end of the flowpath;

the in-solution oil-repellent application method comprising:

with the contacting surface of the contacting piece pressed against the region of the machine component, causing relative movement of the contacting piece superficially on the machine component along the region;

wherein the viscous resistance imparted to the low-viscosity in-solution oil repellent by the microthin flowpath delays, to an extent enabling the repellent-application operation, the outflow of the oil repellent from the opening in the applicator-tip flowpath.

2. An in-solution oil-repellent application method comprising steps of:

applying, by the application method as set forth in claim 1, a low-viscosity in-solution oil repellent to a region of a machine component;

after the flowability of the solution is gone due to the solvent in the coated-on solution vaporizing, again applying by said application method the low-viscosity in-solution oil repellent to at least a part of the coated area of the machine component thereby forming inside the region of the machine component a domain coated two or more times with the low-viscosity in-solution oil repellent.

3. A method of applying along a closed path on a machine-component surface an in-solution oil repellent, the in-solution oil repellent application method comprising steps of:

beginning application of the in-solution oil repellent, by the application method as set forth in claim 2, from one point on said path;

continuing to apply the in-solution oil repellent along said path;

again applying the in-solution oil repellent to at least said one point on said path and then terminating the application of the oil repellent.

4. An in-solution oil-repellent application method as set forth in claim 1, wherein the opening in the flowpath is disposed at a height about equal to the liquid level of the in-solution oil repellent in the reservoir.

5. An in-solution oil-repellent application method as set forth in claim 1, wherein the reservoir is at least partially filled with one or more material from among porous, fibrous, or particulate matter, to add resistance to the flow-through of the in-solution oil repellent.

6. An in-solution oil-repellent application method as set forth in claim 1, wherein the applicator tip is composed of a sheath impervious to the in-solution oil repellent, and covering the contacting piece and at least part of its environs.

7. An in-solution oil-repellent application method as set forth in claim 6, wherein:

the contacting piece has a rotationally symmetrical form with respect to at least one axis; the sheath has a recess in a fore end thereof, and the contacting piece is mounted in the recess in a state in which with respect to the sheath the piece is free to rotate on at least said one axis; and a micro-gap is secured in between an inner peripheral surface of the recess and a circumferential surface of the contacting piece, wherein the flowpath is constituted through the micro-gap.

8. An in-solution oil-repellent application method as set forth in claim 7, wherein:

the contacting piece is solid and is impervious to the in-solution oil repellent, and is rigid enough to, when the oil repellent is solidified, pulverize microparticles of the solidified oil repellent; and at least a part of the microthin flowpath is constituted by the gap secured in between the contacting-piece outer periphery and the sheath.

9. An in-solution oil-repellent application method as set forth in claim 7, wherein:

the contacting piece has a microthin gap internally through which the in-solution oil repellent can flow; and the microthin gap constitutes the applicator-tip flowpath.

10. An in-solution oil-repellent application method as set forth in claim 1, wherein:

the applicator tip and the contacting piece are a unitary component composed made of a porous material provided with rigidity; and pores present in the unitary component form the flowpath.

11. An in-solution oil-repellent application method as set forth in claim 1, wherein:

the applicator tip has a unidirectionally elongated form; and the contacting piece is disposed in the fore end of the applicator tip.

12. An in-solution oil-repellent application method as set forth in claim 1, wherein the method further utilizes a operation jig having a workpiece retainer for retaining the machine component, an applicator-device retainer for retaining the applicator device, and an urging means for acting on one or more from among the applicator device, the applicator-device retainer, or the workpiece retainer, to adjust the force with which the contacting piece is pressed against the region of the machine component.

13. An in-solution oil-repellent application method as set forth in claim 1, wherein the applicator tip is of rigidity such that the area of applicator-tip contact with the machine component does not vary throughout the repellent-application operation.

14. An in-solution oil-repellent application method as set forth in claim 1, wherein the applicator tip has elasticity to be able, by releasing stress associated with the repellent-application operation, to recover its original shape from deformation caused by that stress.

15. An in-solution oil-repellent application method as set forth in claim 1, wherein the oil-repellent resin contains a fluoroplastic resin component.

16. An in-solution oil-repellent application method as set forth in claim 1, wherein the opening in the applicator-tip flowpath is located either on the contacting surface of the contacting piece, or adjacent to the contacting surface, so that the in-solution oil repellent spreads along the contacting surface of the contacting piece.

* * * * *